United States Patent [19]

Tietjens

[11] Patent Number: 4,802,281

[45] Date of Patent: Feb. 7, 1989

[54] DRY SHAVING APPARATUS

[75] Inventor: Eduard W. Tietjens, Eindhoven, Netherlands

[73] Assignee: U.S. Philips Corp., New York, N.Y.

[21] Appl. No.: 205,599

[22] Filed: Jun. 8, 1988

Related U.S. Application Data

[63] Continuation of Ser. No. 943,471, Dec. 16, 1986, abandoned.

[30] Foreign Application Priority Data

Dec. 20, 1985 [NL] Netherlands ..... 8503519
Apr. 24, 1986 [TW] Taiwan ..... 75-101838

[51] Int. Cl.[4] ..... B26B 19/14
[52] U.S. Cl. ..... 30/43.6; 30/346.51
[58] Field of Search ..... 30/43.6, 43.5, 43.4, 30/43.9, 43.92, 346.51

[56] References Cited

FOREIGN PATENT DOCUMENTS 522053 7/1976 U.S.S.R. ..... 30/43.6

*Primary Examiner*—Douglas D. Watts
*Attorney, Agent, or Firm*—Ernestine C. Bartlett

[57] ABSTRACT

A dry-shaving apparatus comprises a housing supporting a holder for a longitudinally extending shear plate provided with hair-entry apertures; and an associated longitudinally extending cutter rotatable about an axis of rotation. The cutter includes a carrier having cutting elements movable relative to the carrier in substantially radial directions, each cutting element having a cutting edge at its radial end. The shear plate has a central portion shaped as a part of a circularly cylindrical surface and formed with the hair-entry apertures, such central portion partly surrounding the cutter. The cutting edges of the cutting elements of the cutter, as it rotates, follow a constrained path defined by the shear plate and a free path where the cutting edges are disengaged from the shear plate. The shear plate also has two peripheral portions respectively adjoining its central portion for securing the shear plate to the holder. The shear plate has a first shear-plate transition between one peripheral portion and its central portion, the cutting edge of each cutting element changing from the free path to the constrained path in the vicinity of the first shear-plate transition, and a second shear-plate transition between the other peripheral portion and its central portion, the cutting edge of each cutting element changing from the constrained path to the free path in the vicinity of the second shear-plate transition.

1 Claim, 2 Drawing Sheets

DRY SHAVING APPARATUS

This is a continuation of Ser. No. 943,471, filed 12/16/86, now abandoned.

FIELD OF THE INVENTION

This invention relates to a dry-shaving apparatus comprising a housing supporting a holder for a longitudinally extending shear plate provided with hair-entry apertures and a cutter which is rotatable about an axis of rotation, which cutter includes carrier having cutting elements which are movable relative to the carrier in substantially radial directions and each of which has a cutting edge at its radial end, the shear plate having a central portion which is shaped as a part of a circularly cylindrical surface and which is formed with the hair-entry apertures, which central portion partly surrounds the cutter, the cutting edges of the cutting elements of the cutter, as it rotates, following a constrained path defined by the shear plate and a free path where the cutting edges are disengaged from the shear plate, the shear plate including two peripheral portions which respectively adjoin the central portion of the shear plate and by which the shear plate is secured to the holder, said shear plate having one shear-plate transition between a first peripheral portion and the central portion of the shear plate, in the vicinity of which first shear-plate transition the cutting edge of each cutting element changes from the free path to the constrained path, and having a second shear-plate transition between the other peripheral portion and the central portion, in the vicinity of which second shear-plate transition the cutting edge of each cutting element changes from the constrained path to the free path.

Such a dry-shaving apparatus is disclosed in, for example, U.S. Pat. No. 3,710,442. At the transition where the ends of the cutting elements in this known apparatus change from the free path to the constrained path the sudden contact between the cutting elements and the shear plate gives rise to undesired vibrations in the cutter, which may lead to damage to the cutter, the shear plate and other parts of the apparatus.

It is the object of the present invention to mitigate this drawback and to this end the invention is characterized in that the axis of rotation of the cutter is situated closer to the second shear-plate transition than to the first shear-plate transition.

DESCRIPTION OF THE DRAWINGS

The invention will now be described in more detail, with reference to the accompanying drawings, in which.

Figure 1:
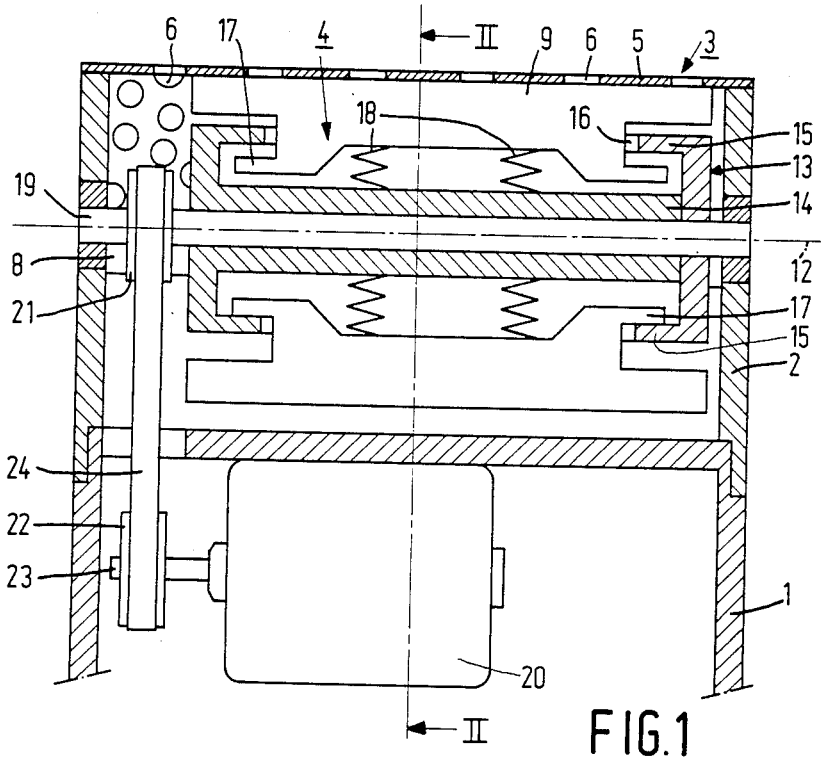
FIG. 1 is a longitudinal sectional view of a dry-shaving apparatus in accordance with the invention.
Figure 2:
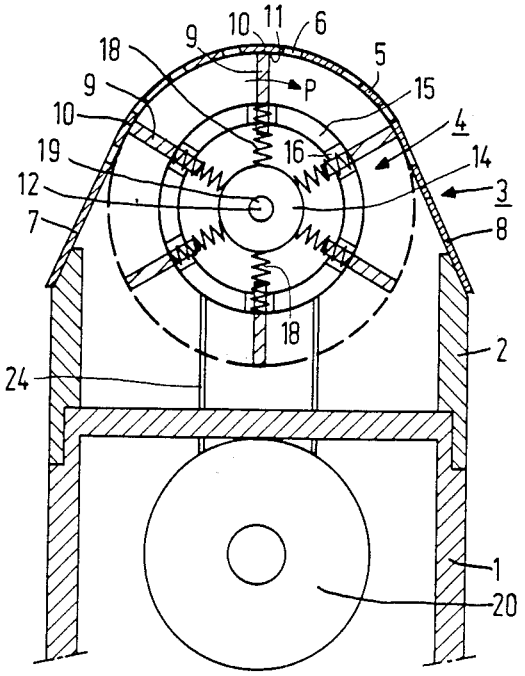
FIG. 2 is a sectional view taken on the line II—II in FIG. 1.

The dry-shaving apparatus shown in FIGS. 1 and 2 comprises a housing 1 provided with a holder 2 for a shear plate 3 and a cutter 4 which is rotatable relative to the shear plate.

The shear plate 3 comprises a central portion 5 having hair-entry apertures 6 and also a first peripheral portion 7 and a second peripheral portion 8 by which the shear plate is secured to the holder 2.

The cutter 4 comprises cutting elements 9 each having a cutting edge 11 at its radial end 10. The cutter 4 is journalled in the holder 2 so as to be rotatable about axis of rotation 12 and is partly surrounded by the central portion 5 of the shear plate 3. Hairs which project inwards from the hair-entry apertures 6 can be cut by cooperation of the portion 5 of the shear plate 3 with the ends 10 of the cutting elements 9 which slide along the inner side of the portion 5.

The cutter 4 includes a carrier 13 for the cutting elements 9, which carrier comprises a hub 14 and a cylindrical portion 15 having slots 16. The cutting elements 9 are disposed partly inside the slots 16 and are movable over a limited distance in a radial direction relative to the carrier. The hook-shaped ends 17 of the cutting elements are situated between the hub 14 and the cylindrical portion 15 and ensure that the cutting elements 9 cannot fall out of the carrier 13. Pressure springs 18 are arranged between the hub 14 and the cutting elements 9 to exert outwardly directed radial forces on the cutting elements 9.

The hub 14 is mounted on a spindle 19 which is journalled in the holder 2 so as to be rotatable about the axis of rotation 12. The housing 1 accommodates an electric motor 20 for driving the cutter 4, for example in a direction of rotation as indicated by the arrow P (FIG. 2). The rotation of the motor 20 is transmitted to the cutter 4 by means of pulleys 21 and 22, mounted on the spindle 19 and the motor shaft 23 respectively, and the drive belt 24.

Figure 3:
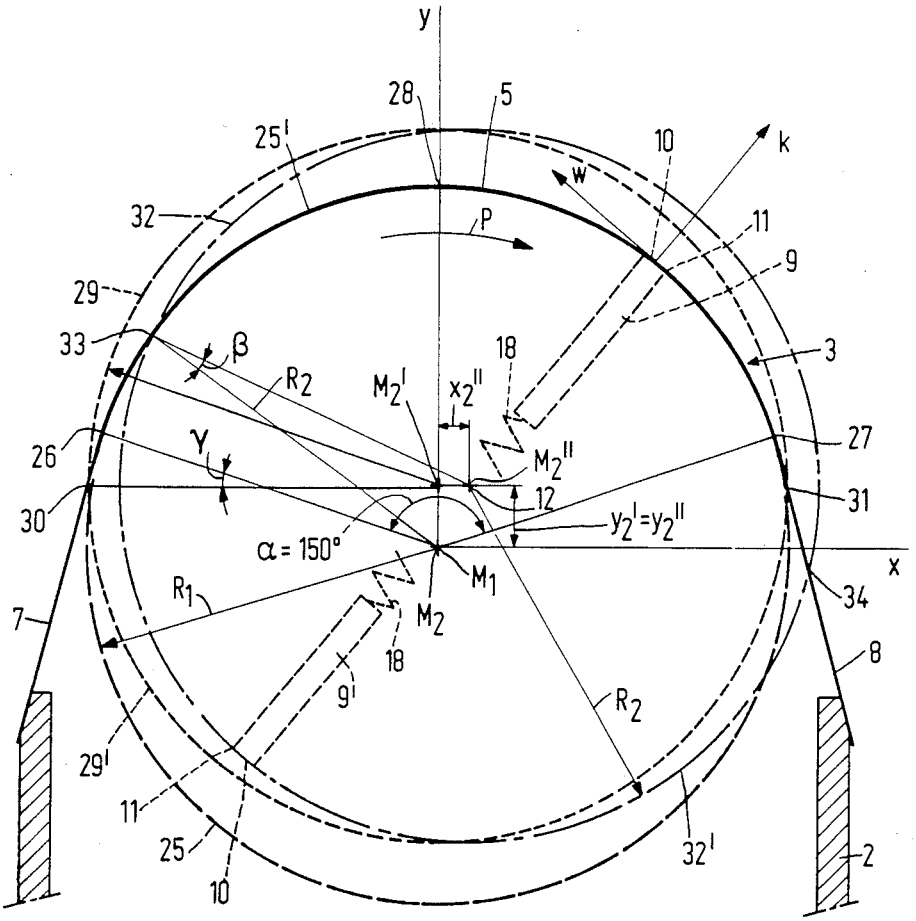
FIG. 3 is an enlarged-scale simplified sectional view similar to that of FIG. 2.

FIG. 3 is an enlarged-scale simplified sectional view similar to that shown in FIG. 2. The shear plate 3 comprises a central portion 5 which is shaped as a part of a cylindrical surface represented by an arc of circle 25′ which forms part of a circle 25 having a centre $M_1$ and a radius $R_1$. At the shear-plate transitions 26 and 27 the arc of circle 25′ is contiguous with the peripheral portions 7 and 8 respectively of the shear plate 3. These peripheral portions 7 and 8 extend for example in directions defined by planes tangent to the central portion 5 at the location of the shear-plate transitions 26 and 27. The arc of circle 25′ corresponds to a central angle $\alpha = 150°$.

If the cutting elements 9 of the cutter 4 are subjected only to the forces exerted by the pressure springs 18, gravitational force being ignored, the cutting elements 9 will be urged outwards as far as possible relative to the carrier 13 by the pressure springs 18, causing the hook-shaped ends 17 to engage against the cylindrical portion 15 (FIG. 1). When the cutter 4 is rotated about the axis of rotation 12 the free path followed by the cutting edges 11 at the ends 10 of the cutting elements may be represented as a cylindrical surface whose cross-section is given by a circle having a centre $M_2$, as is shown in FIG. 3. If the radius $R_2$ of this circle is equal to the radius $R_1$ of the circle 25 and the centre $M_2$ coincides with the centre $M_1$, the free path of the cutting edges 11 in FIG. 3 consequently coincides with the circle 25. Theoretically, there will be no pressure between an end 10 of a cutting element 9 and the shear plate 3 in this situation.

For effectively cutting a hair by the cooperation of a cutting element with the shear plate, however, a pressure is required between these two parts. Moreover, in practice the holder 2, the shear plate 3 and parts of the cutter 4 are subject to manufacturing tolerances, i.e. dimensional errors as a result of manufacturing inaccuracies are accepted within specified limits. During assembly of the shaving apparatus parts with dimensional errors may be combined in such a way that in the situation in which $M_1$ coincides with $M_2$ the ends 10 remain clear of the shear plate 3 during a revolution which effect, referred to as a cutting gap, has an even more unfavourable influences on the shaving action than the absence of a pressure force.

In order to preclude the occurrence of cutting gaps as a result of an unfavourable accumulation of dimensional errors and in order to ensure that pressure forces act between the cutting elements and the shear plate, the cutter 4 may be displaced relative to the shear plate 3. If an axis from $M_1$ through the middle 28 of the arc of circle 25' is defined as the positive y-axis the cutter may be shifted along this positive y-axis, for example until the axis of rotation 12 coincides with the centre $M_2'$. The free path of the cutting edges 11 may then be represented by an arc of circle 29' which forms part of a circle 29 having a radius $R_2$ and a centre $M_2'$ on the positive y-axis. This circle 29 intersects the shear plate at the location of a first path-transition 30 which is situated near the first shear-plate transition 26 where the central portion 5 adjoins the first peripheral portion 7. For the direction of rotation of the cutter 4 indicated by the arrow P in FIG. 3 the ends 10 of cutting edges 11 following the free path 29' come into contact with the shear plate 3 at the first path-transition 30. As movement proceeds the ends 10 slide along the shear plate and the cutting edges follow a constrained path defined by the shear plate.

The circle 29 also intersects the shear plate 3 at the location of the second path-transition 31 near the second shear-plate transition 27, where the central portion 5 adjoins the second peripheral portion 8. At the second path-transition 31 the ends 10 become disengaged from the shear plate 3 after which the cutting edges 11 again follow the free path 29'.

For the direction of rotation P the constrained path defined by the shear plate 3 extends from the first path-transition 30 to the second path-transition 31 and is situated within the circle 29 defining the free path. The ordinate $Y_2'$ of the centre $M_2'$ is selected so as to preclude the occurrence of cutting gaps as a result of dimensional errors and, moreover, in such a way that in the constrained path the cutting elements 9 are urged slightly inwards by the shear plate 3 against the action of the pressure springs 18. As a result, the springs 18 exert a radial pressure K on the cutting elements 9 and the cutting elements engage the shear plate with a similar force K acting in a radial direction.

During rotation of the cutter 4, the cutting elements 9 are subjected to a frictional force W caused by the force K. In order to minimise frictional losses between the ends 10 of the cutting elements 9 and the shear plate 3 the length of the constrained path should be as small as possible. In order to achieve this a value of 150° or smaller is generally selected for the central angle $\alpha$, as shown in FIG. 3, associated with the arc of circle 25' of the central portion 5.

By shifting the axis of rotation 12 and hence shifting the centre $M_2'$ to $M'_2$ the circle 29 will intersect the shear plate at the location of the peripheral portions 7 and 8. This means that after the free path the ends 10 of the cutting elements 9 come into contact with the first peripheral portion 7 at the first path-transition 30. This sudden contact may be regarded as a collision between a cutting element and the shear plate, which may give rise to vibrations in the apparatus which may impair the shaving action of the apparatus and may even lead to damage. These collisions may also result in substantial forces acting between the shear plate and the cutting elements, which may also give rise to damage. These forces may occur, in particular, if the cutting elements 9 are mounted in the carrier 13 so as to obtain a self-biassing or self-locking effect, which are commonly used techniques in shaving apparatuses.

For a uniform transition from the free path to the constrained path, which is required in order to minimise the above collision effects and the undesirable consequences thereof, it is found to be essential that the first path-transition is situated on the arc of circle 25' between the first and second shear-plate transitions 26 and 27 respectively. This is achieved if the axis of rotation 12 of the cutter 4 is situated closer to the second shear-plate transition 27 than to the first shear-plate transition 26.

If in the cross-sectional view of FIG. 3 the positive x-axis is defined as an axis perpendicular to the y-axis from $M_1$ to the side of the second shear-plate transition 27, the location of the axis of rotation 12, which is represented by $M_2''$, is preferably situated in the quadrant defined by the positive x-axis and the positive y-axis with positive coordinates $x_2''$ and $y_2''$. For simplicity $y_2''$ is assumed to be equal to $y_2''$. An arc of circle 32', which is part of a circle 32 having a centre $M_2''$ and a radius $R_2=R_1$, represents the free path which extends from the second path-transition 34 to the first path-transition 33 in the direction of rotation P. As can be seen in FIG. 3, the first path-transition 33 is situated on the arc of circle 25', i.e. after the cutting edges 11 have traversed the free path the cutting elements come directly into contact with the central portion 5 of the shear plate which is curved as a cylindrical surface. The constrained path consequently extends in the direction of rotation P from the first path-transition 33 along the arc of circle 25' and partly along the peripheral portion 8 to the second path-transition 34. The fact that the second path-transition is situated on the peripheral portion 8 has no adverse effect, because at this location the constrained path changes into the free path 32' and this is not attended by collision effects.

In FIG. 3 the shear plate is represented by a few lines as a foil without any thickness. In fact, the lines 7, 8 and 25' represent the inner side of the shear plate. Further, it is assumed that as the cutter rotates the cutting edges 11 of the cutting elements 9 always come into contact with the inner side of the shear plate, so that the cutting edges follow the constrained path as defined above.

Instead of coupling the cutter to the motor by means of a belt transmission this is also possible by means of, for example, a gearwheel transmission. The biassing force for the cutting elements may also be provided by magnetic or centrifugal forces instead of spring forces.

The transition of a cutting edge from the free path to the constrained path will be smoother as the angle between the tangent line to the free path and the tangent line to the shear plate at the location of the first path-transition decreases. For the first path-transition 33 this angle corresponds to the angle $\beta$ between the radii from $M_1$ and $M_2''$ to point 33. For the first path-transition 30 this angle corresponds to the angle $\gamma$ between the radius from $M_1$ to the first shear-plate transition 26 and the radius from $M_2'$ to the first path-transition 30. Since these radii intersect one another within the circle 29, the angle $\gamma$ is larger than the angle $\beta$. In FIG. 3 the angle $\gamma$ is approximately twice as large as the angle $\beta$. Thus, by shifting the axis of rotation 12 towards the second shear-plate transition 27 it is possible to obtain a substantial improvement with respect to smooth engagement of the cutting elements with the shear plate.

In the embodiment described in the foregoing the central portion of the shear plate is shaped as a part of a circularly cylindrical surface having the same radius as the free path of the cutting edges of the cutting elements. Generally, it will be favourable for the operation of the apparatus if the shape and dimensions of the central portion of the shear plate are thus adapted to the rotating cutter. The advantages of such shift of the axis of rotation, however, can also be obtained in those cases in which the radius of the central portion deviates from that of the free path or in which the central portion has a shape other than that of a circularly cylindrical surface. By moving the axis of rotation towards the second shear-plate transition it is also possible to ensure that in such cases the first path-transition is situated at the location of the central portion, so that a smooth transition from the free path to the constrained path is obtained and the adverse effects of a collision of the cutting elements with the shear plate are avoided.

What is claimed is:

1. A dry-shaving apparatus comprising a housing supporting a holder for a longitudinally extending shear plate provided with hair-entry apertures; and an associated longitudinally extending cutter rotatable about an axis of rotation, said cutter including a carrier having cutting elements movable relative to the carrier in substantially radial directions, each cutting element having a cutting edge at its radial end; the shear plate having a central portion shaped as a part of a circularly cylindrical surface and formed with the hair-entry apertures, said central portion partly surrounding the cutter; the cutting edges of the cutting elements of the cutter, as it rotates, following a constrained path defined by the shear plate and a free path where the cutting edges are disengaged from the shear plate; the shear plate also having two peripheral portions respectively adjoining the central portion of the shear plate for securing the shear plate to the holder; the shear plate having a first shear-plate transition between one peripheral portion and its central portion, the cutting edge of each cutting element changing from the free path to the constrained path in the vicinity of the first shear-plate transition, and having a second shear-plate transition between the other peripheral portion and its central portion, the cutting edge of each cutting element changing from the constrained path to the free path in the vicinity of the second shear-plate transition; the free path followed by the radial ends of the cutting elements being situated on a cylindrical surface having its axis coinciding with the axis of rotation of the cutter; a line from the axis of the circularly cylindrical shear plate through the centre of the central portion of the shear plate defining a positive y-axis, and a line perpendicular to such y-axis from the axis of the circularly cylindrical shear plate towards the second shear-plate transition defining a positive x-axis; and the axis of rotation of the cutter being situated closer to the second shear-plate transition than to the first shear-plate transition and also being situated in the quadrant defined by the positive x-axis and the positive y-axis whereby said cutting elements enter and leave the first and second shear-plate transitions reducing the effects of collisions between the cutting elements and the shear plate.

* * * * *